US006148556A

United States Patent [19]

Seki

[11] Patent Number: 6,148,556

[45] Date of Patent: Nov. 21, 2000

[54] SHOP FRONT DISPLAY

[75] Inventor: Kazuharu Seki, Tokyo, Japan

[73] Assignees: Triall Limited; Kazuharu Seki, both of Tokyo, Japan

[21] Appl. No.: 09/196,533

[22] Filed: Nov. 20, 1998

[30] Foreign Application Priority Data

Nov. 21, 1997 [JP] Japan ..... 9-338039

[51] Int. Cl.[7] ..... G09F 3/18

[52] U.S. Cl. ..... 40/661; 40/649; 40/661.09; 40/594; 40/611

[58] Field of Search ..... 40/649, 661, 661.01, 40/661.09, 594, 597, 600, 611, 615, 709, 765, 489, 490

[56] References Cited

U.S. PATENT DOCUMENTS

| | | | |
|---|---|---|---|
| 3,847,325 | 11/1974 | Nasalski et al. | 229/92.8 |
| 3,918,187 | 11/1975 | Vogele | 40/611 X |
| 4,413,434 | 11/1983 | Rupert et al. | 40/661 |
| 4,662,093 | 5/1987 | Suttles et al. | 40/594 X |
| 4,765,074 | 8/1988 | Loos | 40/661 |
| 4,946,039 | 8/1990 | Garran | 206/575 |
| 4,955,153 | 9/1990 | Albrecht et al. | 40/649 X |
| 5,025,581 | 6/1991 | Polzin | 40/594 X |
| 5,161,827 | 11/1992 | Grosso | 40/661 X |
| 5,261,174 | 11/1993 | Blegen | 40/594 X |
| 5,524,373 | 6/1996 | Plumly | 40/600 |
| 5,918,398 | 7/1999 | Stanley et al. | 40/594 |

*Primary Examiner*—Lynne H. Browne
*Assistant Examiner*—Andrea Chop
*Attorney, Agent, or Firm*—Flynn, Thiel, Boutell & Tanis, P.C.

[57] ABSTRACT

A shop front display comprises a base member in the form of a thin sheet which can be applied to a member such as a shop shelf or an exhibition case by a first adhesion layer, a transparent cover disposed in overlapping relationship with the front surface of the base member, and a second adhesion layer formed on either one of the base member and the cover. The respective adhesion layers are formed to allow a repeated application or removal. The first adhesion layer permits the shop front display to be applied to a shop shelf or an exhibition case. When the cover is applied to the base member, an intermediate sheet can be maintained therebetween or characters inscribed on the base member can be protected. Instead of inscribing characters, display sheets may be applied to the base member and the cover may be dispensed with. In this manner, the shop front display is resistant to marring or damage and easily handled while suppressing the cost involved.

17 Claims, 2 Drawing Sheets

SHOP FRONT DISPLAY

FIELD OF THE INVENTION

The invention relates to a shop front display which is suitable for use in representing prices of goods at a shop front.

DESCRIPTION OF THE PRIOR ART

POP (point of purchase) papers are extensively used to indicate prices of goods. Data such as trade name or name of goods, price or producer or place of production thereof are printed or entered manually on a POP paper, which is then applied to a shelf or an exhibition case by an adhesive tape such as cellophane tape to draw attention of customers.

However, most POP papers are not water resistant and hence are easily marred or damaged. The prior art practice to accommodate for such drawback has been to seal the POP paper with transparent laminate resin in order to protect it from marring or damage. However, the coating with laminate resin is disadvantageously expensive because it costs nearly 100 Japanese yens per POP paper.

In addition, the POP paper or its version with laminate resin coating requires a troublesome application work, using cellophane tape to apply it to the shelf or case. This also resulted in a disadvantage that the adhesive remains as residue on the shelf or the wall of the case to leave a marring thereon when POP paper is removed.

SUMMARY OF THE INVENTION

In view of the foregoing, the invention provides a shop front display which is resistant to marring and damage, easily applied and useable repeatedly while being inexpensively used.

A first embodiment of the invention comprises a base member in the form of a thin sheet, a first adhesion layer on the rear surface of the base member which allows the base member to be repeatedly applied to or removed from a shop shelf or the wall of an exhibition case, a transparent cover disposed in overlapping relationship with the front surface of the base member, and a second adhesion layer on one of the base member and the cover which overlap each other to allow the other of the base member and the cover to be repeatedly applied.

The invention can also comprise comprises a base member in the form of a thin sheet, a first adhesion layer on the rear surface of the base member which allows the base member to be repeatedly applied to or removed from a shop shelf or the wall of an exhibition case (impermanently secured), and a plurality of display sheets each being smaller than the base member and each bearing a numerical figure or a symbol, each display sheet being associated with a second adhesion layer on either one of its rear surface and the front surface of the base member which allows a repeated adhesion of the display sheet with the base member, a choice of display sheets being applied to the base member.

According to the invention, the cover can be disposed in overlapping relationship with the base member and applied to the latter by the second adhesion layer, whereby the cover is effective to protect characters inscribed on the base member or an intermediate sheet such as POP paper which is interposed between the base member and the cover. This prevents an erasure of inscribed characters on the base member or prevents the intermediate sheet from damage. The first adhesion layer on the rear surface of the base member facilitates the application of the base member to the shop shelf or the wall of the case.

According to the invention, a plurality of display sheets which may be as many as desired can be applied to the base member to serve as a POP paper. The first adhesion layer on the rear surface of the base member facilitates the application of the latter to the shop shelf or the wall of the case. The provision of the first and the second adhesion layer permits a repeated use of the base member and the cover, thus allowing the required cost to be suppressed.

Above and other objects, features and advantages of the invention will become apparent from the following description of an embodiment thereof with reference to the attached drawings.

DETAILED DESCRIPTION OF THE EMBODIMENTS

Figure 1:
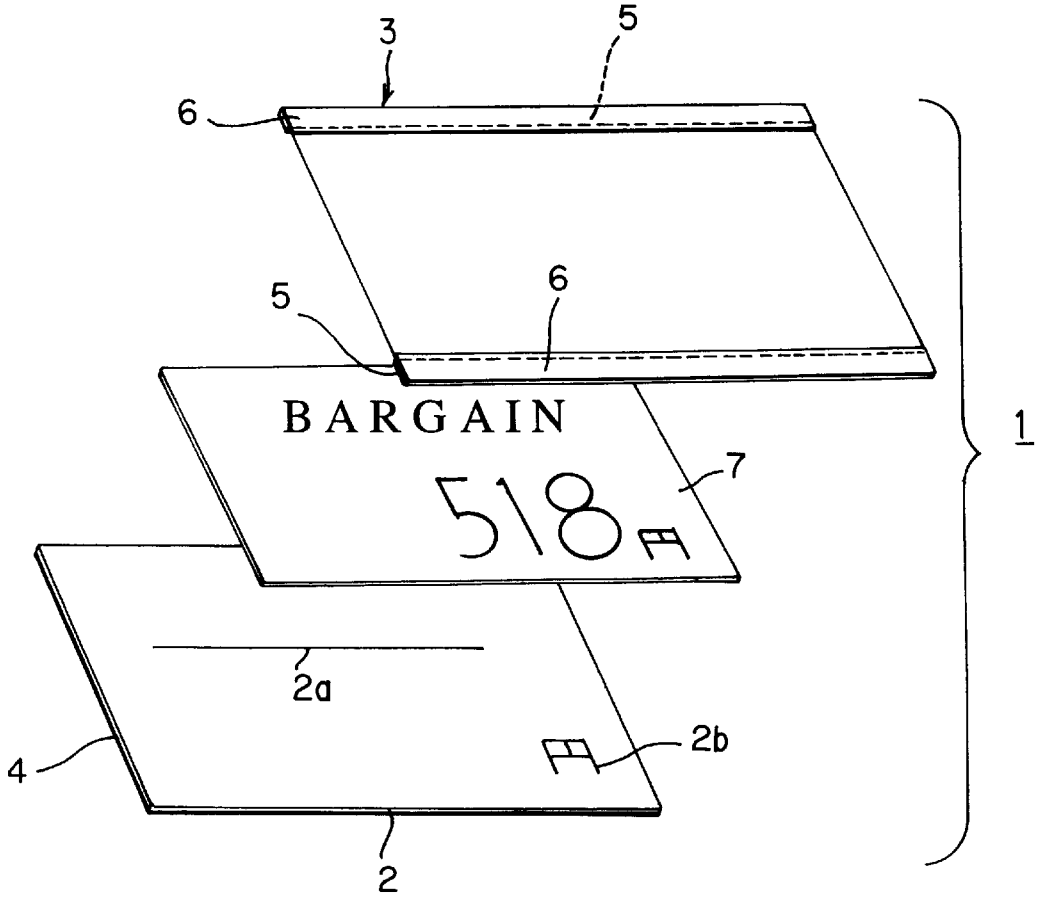
FIG. 1 is a perspective view of one embodiment of the invention.

Referring to the drawings, the invention will be specifically described. Initially, referring to FIG. 1, a shop front display 1 comprises a rectangular base member 2, and a transparent cover 3 of an identical size with the base member 2 and disposed in overlapping relationship with the front surface of the base member 2. It should be understood that a translucent cover is also contained within the term "the transparent cover" according to the invention.

Figure 2:
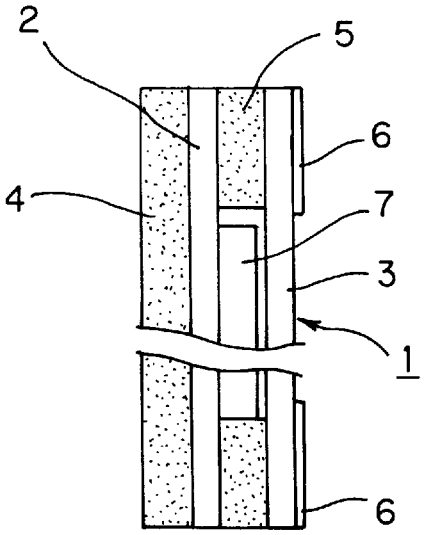
FIG. 2 is an elevational section of an assembled shop front display 1 shown in FIG. 1.
Figure 3:
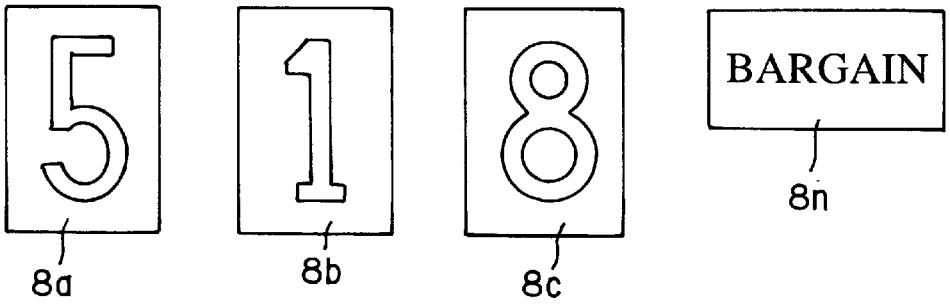
FIG. 3 is a plan view of several display sheets 8*a*, 8*b*, 8*c*, . . . 8*n* which are used in accordance with the invention.

As shown in FIG. 2, the base member 2 is manufactured from a soft synthetic resin such as PET (polyethylene terephthalate) resin, for example, and a first adhesion layer 4 is formed on the entire rear surface of the base member 2.

The base member 2 has a front surface which is formed as a smooth white board, on which characters can be entered with a signature pen using an alcoholic ink and such characters can be easily erased. The white board is initially printed with predetermined indicia such as a centrally located horizontal line 2*a* and an YEN indication 2*b* on the right bottom corner which cannot be erased.

The first adhesion layer 4 provided on the rear surface of the base member 2 may comprise a material known by the tradename of PAPIRAL™) having a myriad of air bubbles and exhibiting a sucker effect, for example, thus allowing the base member 2 to be repeatedly applied to or removed from the shop shelf or the wall of an exhibition case. However, it should be understood that the material for the first adhesion layer 4 is not limited to PAPIRAL™, but that any material may be used which permits a repeated application or removal of the base member 2 to or from the shop shelf or the case wall.

On the other hand, the cover 3 is manufactured from a soft synthetic resin, which may be transparent PET resin, for example. A pair of elongate strip-shaped second adhesion layers 5 are formed along longitudinals edges on the rear surface of the cover 3 or its surface facing the base member 2.

Each of the second adhesion layers 5 may comprise the same material as that used to form the first adhesion layer 4 on the base member 2, for example, thus allowing the longitudinal edges of the cover 3 to be repeatedly applied to or removed from the front surface of the base member 2. A pair of colored, opaque tapes 6 of a width greater than the width of the second adhesion layer 5 are bonded to the front surface of the transparent cover 3 along longitudinal edges, thus making the second adhesion layer 5 invisible when viewed from the front side.

In the present embodiment, an arrangement is made so that an intermediate sheet 7 such as POP paper can be received and maintained between the base member 2 and the cover 3. The longitudinal length of the sheet 7 or the length of its longer side which extends horizontally as viewed in FIG. 1 is substantially commensurate with the longitudinal length of the base member 2, but its shorter side has a length which is less than the spacing between the pair of second adhesion layers 5, thus preventing the intermediate sheet 7 from interferring with the adhesion of the layers 5 on the cover 3 with the base member 2. The intermediate sheet 7 is previously printed or inscribed with the tradename of goods, its price, producer or place of production and the like.

With the described arrangement, the intermediate sheet 7 may be interposed between the base member 2 and the cover 3 and the second adhesion layers 5 on the cover 3 adhesively bonded to the base member 2, whereupon the intermediate sheet 7 can be maintained between the base member 2 and the cover 3. The shop front displays comprising the base member 2, the intermediate sheet 7 and the cover 3 may then be applied to the shop shelf or the case wall by utilizing the first adhesion layer 4 on the base member 2.

Under this condition, the intermediate sheet 7 is covered by the base member 2 and the cover 3, both of which are formed of synthetic resin and thus are water resistant, whereby it is protected from water, marring and damage.

When changing the intermediate sheet 7, the entire shop front display 1 is stripped from the case or the like, and then the intermediate sheet 7 is removed. It may be pulled out through an opening formed between the base member 2 and the cover 3 along the lateral edges thereof, or may be removed by peeling one of the second adhesion layers and turning up the cover 3 in a region toward the peeled second adhesion layer 5, or may be removed by completely peeling the cover 3 off the base member 2. When the intermediate sheet 7 is removed in this manner, a substitute intermediate sheet 7 may be maintained between the base member 2 and the cover 3. Since the first adhesion layer 4 and the second adhesion layers 5 are repeatedly operable, it is possible to use the base member 2 and the cover 3 repeatedly.

The base member 2 of the shop front display 1 may be used as a white board by itself In this instance, using a signature pen which uses an alcoholic ink, the name of goods may be inscribed along the horizontal line 2*a* and the price may be inscribed in alignment with the YEN indication 2*b*. Subsequently, the cover 3 may be applied to the base member 2 without interposing an intermediate sheet 7 therebetween. Characters inscribed on the front surface of the base member 2 are covered by the cover 3 and thus cannot be easily erased.

Alternatively, a plurality of display sheets 8*a*, 8*b*, 8*c*, . . . 8*n* which are smaller than the base member 2 and each bearing a numerical figure or symbol may be prepared, and a choice of them may be used instead of, and/or in addition to, inscribing characters on the base member by using a signature pen.

In the present embodiment, each of the display sheets 8*a*, 8*b*, 8*c*, . . . 8*n* is provided with an adhesion layer on its entire rear surface in the similar manner as the base member 2, but has a thickness which is reduced as compared with the thickness of the base member 2.

In case the display sheets 8*a*, 8*b*, 8*c*, . . . 8*n* are used, the use of the cover 3 may be omitted since they are each formed of synthetic resin to exhibit water resistance. Alternatively, where the cover 3 is used, the display sheets may be formed of paper.

In the described embodiment, an arrangement is employed in which the cover 3 can be completely separated from the base member 2, but the invention is not limited to such an arrangement and an alternative arrangement may be used in which the base member 2 and the cover 3 are connected together along one edge, which may be an upper edge as viewed in FIG. 1, in an inseparable manner.

In addition, it is not always necessary that the second adhesion layers 5 be provided on the cover 3, but they may be provided on the base member 2. In the latter instance, a single second adhesion layer corresponding to adhesion layers 5 may be provided on the entire front surface of the base member 2 as required. If the second adhesion layer 5 is provided on the front surface of the base member 2, adhesion layers on individual display sheets 8*a*, 8*b*, 8*c*, . . . 8*n* can be omitted.

While the invention has been disclosed above in connection with one embodiment of the invention, it should be understood that a number of changes, modifications and substitutions therein are possible from the above disclosure without departing from the spirit and scope of the invention defined by the appended claims.

What is claimed is:

1. A shop front display comprising a base member in the form of a thin sheet, a cover with an opening between the base member and the cover, a first adhesion layer formed on a rear surface of the base member enabling repeated application to and removal from a surface of an exhibition case, and a plurality of display sheets, each of which is smaller than the base member and bears a numerical figure or symbol, an adhesion layer on one of (1) a rear surface of each display sheet and (2) a front surface of the base member which enables repeated application to and removal from the base member of selected ones of the display sheets, and when the base member and the cover are attached to one another, there is sufficient distance for one of the display sheets to be slid into the opening between the base member and the cover, and that the base member and the cover are attached to one another using an impermanent adhesive.

2. A shop front display according to claim 1, wherein the front surface of the base member comprises a white board.

3. A shop front display comprising a base member in the form of a thin sheet, a first adhesion layer formed on a rear surface of the base member and enabling the base member to be repeatedly applied to surfaces including shop shelves and show case walls, a transparent cover having flexibility and overlapped over a front surface of the base member, and a second adhesion layer provided on at least one of (1) the front surface of the base member and (2) a rear surface of the cover and enabling the base member and the cover to be repeatedly applied to each other, wherein the cover is at least partly separable from the base member, such that when the base member and the cover are attached to one another, there is sufficient distance for a display sheet to be slid into the opening between the base member and the cover, wherein the base member and the cover are attached to one another using an impermanent adhesive.

4. A shop front display according to claim 3, wherein the base member and the cover are inseparably connected together along part of their peripheral edges.

5. A shop front display according to claim 3, wherein the second adhesion layer is provided on the cover in a strip form along one side of the cover.

6. A shop front display according to claim 3, further comprising a plurality of display sheets, each of which is smaller than the base member and bears a symbol, selected ones of the display sheets being applied to the base member.

7. A shop front display according to claim 6, wherein each of the symbols comprises a numerical figure.

8. A shop front display according to claim 3, further comprising a plurality of display sheets, each display sheet having a surface, each smaller than the base member and bearing an impression of a portion of the second adhesion layer each provided on either the surface of each display sheet or the front surface of the base member and securing one of each display sheet to the base member, wherein a certain number of the display sheets selected from the plurality of display sheets are applied to the base member.

9. A shop front display according to claim 3, further comprising an intermediate sheet disposed between the base member and the cover for maintenance therebetween.

10. A shop front display according to claim 3, wherein the front surface of the base member comprises a white board.

11. A shop front display comprising:

a base member comprising a thin sheet;

a first impermanent adhesion layer formed on a rear surface of said base member enabling repeated application and removal of said base member with respect to a flat surface;

a flexible transparent cover overlapping a front surface of said base member;

a second impermanent adhesion layer provided on one of (1) the front surface of said base member and (2) a rear surface of said cover for enabling repeated application and removal of said cover from said base member; and the base member and the cover having sufficient distance for a display sheet to be slid into the opening between the base member and the cover.

12. The shop front display according to claim 11, wherein said second impermanent adhesion layer extends about an outer peripheral portion of the rear surface of said cover.

13. The shop front display according to claim 11, wherein said second impermanent adhesion layer extends about an outer peripheral portion of the front surface of said base member.

14. The shop front display according to claim 13, further including a plurality of display sheets each include a symbol on a front surface thereof and a third impermanent adhesion layer on a rear surface thereof.

15. The shop front display according to claim 14, wherein the symbols include numeral figures.

16. The shop front display according to claim 11, wherein a third impermanent adhesion layer is positioned near a center on the front surface of said base member for receiving display sheets.

17. The shop front display according to claim 11, further including a plurality of display sheets each include a symbol on a front surface thereof and a third impermanent adhesion layer on a rear surface thereof.

* * * * *